US008905818B2

(12) United States Patent
Amsent

(10) Patent No.: US 8,905,818 B2
(45) Date of Patent: Dec. 9, 2014

(54) PROCESS FOR THE MANUFACTURE OF STONE BLOCKS

(76) Inventor: Leon Amsent, North York (CA)

( * ) Notice: Subject to any disclaimer, the term of this patent is extended or adjusted under 35 U.S.C. 154(b) by 437 days.

(21) Appl. No.: 13/373,189

(22) Filed: Nov. 8, 2011

(65) Prior Publication Data

US 2012/0118277 A1 May 17, 2012

(51) Int. Cl.

| | |
|---|---|
| ***B24B 1/00*** | (2006.01) |
| ***B28D 1/02*** | (2006.01) |
| ***B24B 11/00*** | (2006.01) |
| ***B28D 1/18*** | (2006.01) |

(52) U.S. Cl.

CPC . *B28D 1/02* (2013.01); *B24B 11/00* (2013.01); *B28D 1/18* (2013.01)

USPC ..... 451/41; 451/55; 125/13.01; 125/24

(58) Field of Classification Search

CPC ..... B28D 1/02; B28D 1/18

USPC ..... 125/13.01; 451/41, 54, 55

See application file for complete search history.

(56) References Cited

U.S. PATENT DOCUMENTS

| | | | | |
|---|---|---|---|---|
| 1,255,761 | A | 2/1918 | Lenkerd | |
| 2,006,910 | A | 7/1935 | Brooks | |
| 2,205,404 | A | 6/1940 | Fuller | |
| 3,606,470 | A * | 9/1971 | Blum | 73/864.41 |
| 4,815,897 | A | 3/1989 | Risi et al. | |
| 4,860,505 | A * | 8/1989 | Bender | 405/286 |
| D346,667 | S | 5/1994 | Blomquist et al. | |
| 6,539,933 | B1 * | 4/2003 | Nordhagen | 125/23.01 |

* cited by examiner

*Primary Examiner* — Maurina Rachuba

(74) *Attorney, Agent, or Firm* — Riches, McKenzie & Herbert, LLP

(57) ABSTRACT

This invention relates to a process which may be automated for the manufacture of stone blocks for use as finished landscape stone blocks from quarry stone. The natural stone is quarried from the quarry and split into rectangular blocks, with squared ends and the top and bottom surfaces are ground with a plurality of grooves and ridges of varying heights. The ridges of varying heights are then removed thereby producing a surface having ridges of uniform height and grooves of uniform depth. The blocks may be used to form an architectural wall. The process is also applicable to pavers, steps and coping stones.

13 Claims, 6 Drawing Sheets

PROCESS FOR THE MANUFACTURE OF STONE BLOCKS

SCOPE OF THE INVENTION

This invention relates to a new process for manufacturing stone blocks for use as finished landscape stone blocks or building blocks from quarry stone. The blocks carry grooves on the top and bottom surfaces to secure the blocks together to make a garden wall or an architectural wall. This configuration prevents shifting or movement of the blocks, particularly in the winter seasons. The process may also be used to produce pavers, steps and coping stones which are used as building and landscape stones. These stones will carry grooves only on the bottom surface.

BACKGROUND OF THE INVENTION

Description of the Prior Art

It has become very popular to use architectural walls when building new exterior landscaping projects particularly in residential settings, such as houses, gardens and the like.

These walls may take many forms and can be made of different materials. One very popular material is stone to try to achieve a natural look to the landscape.

Multi-piece wall systems having a stacked stone appearance are used by architects, landscape contractors and builders in a variety of applications. These include on terraces, stepping stones, gardens and as retaining walls.

Many of the structures are made from architectural grade precast concrete. However there is a strong demand today for these structures to be made from natural stone.

One of the goals is to make the project look as natural as possible and thus the desire to use natural stone. The use of natural stone has captured the attention of the architectural world and the renovating world.

The prior art shows the use of building blocks for forming retaining walls, which carry grooves on one or more surfaces and which interact with each other. However, none of these blocks are made from quarry stone.

U.S. Pat. No. 1,255,761 to Lenkerd was an early patent issued in 1918, which discloses a building block having a plurality of longitudinal grooves with a width and a depth of about one-half an inch, which provide a seat for the mortar between adjacent blocks. The blocks are made of clay or an equivalent material and are used to form retaining walls.

U.S. Pat. No. 2,006,910 to Brooks discloses interlocking fir bricks slotted on the top and bottom faces top permit the bonding of the bricks by the use of cement.

U.S. design Pat. No. 346,667 to Blomquist shows a retaining wall block with a plurality of groove son one surface whereas the opposite surface is plain.

U.S. Pat. No. 4,860,505 to Bender discloses a construction block, which carries a series of ridges on one side and grooves on the other side.

U.S. Pat. No. 4,815,897 to Risi discloses an interlocking block preformed concrete interlocking blocks which use a header between respective blocks.

U.S. Pat. No. 2,205,404 to Fuller discloses a preformed block for use in masonry walls using mortar anchorage to retain the blocks.

The problem, with the prior art is that no one has been able to manufacture blocks from natural stone which can be used safely as building blocks, which will be able to be secured in place, which are safe to use and which do not move especially during the winter when they are subject to environmental conditions.

No one has been able to manufacture suitable blocks from quarry stone using an automated process.

SUMMARY OF THE INVENTION

To at least partially overcome the disadvantages of the prior art, the present invention provides an automated process for manufacturing natural split-face landscape and building stone blocks having specific dimensioned heights and widths from uneven layers of stone.

A further object of this invention is to provide a process which can be fully automated.

A still further object of this invention is to an automated process for manufacturing natural split-face landscape and building stone blocks having specific dimensioned heights and widths from uneven layers of limestone, sandstone and metamorphic stone and granite.

Accordingly, in one aspect, the invention provides a process for the manufacture of stone blocks for use as finished landscape stone blocks from quarry stone comprising quarrying natural stone from a quarry, splitting the quarried stone into rectangular blocks having a top surface, a bottom surface and two end faces, sawing each end face of said block to produce squared ends of said block, grinding the top surface of said block to produce a plurality of longitudinal grooves and ridges of varying heights, removing the ridges of varying height from said top surface thereby producing a surface having ridges of uniform height and grooves of uniform depth, rotating said block 180 degrees to an upside down position, grinding said bottom surface to produce a plurality of longitudinal grooves and ridges of varying height, and removing said ridges of varying height from said bottom surface thereby producing a surface having ridges of uniform height and grooves of uniform depth.

In another of its aspects, the invention provides a process for the manufacture of stone blocks for use as building stone blocks from quarry stone comprising quarrying natural stone from a quarry, splitting the quarried stone into rectangular blocks having a top surface, a bottom surface and two end faces, sawing each end face of said block to produce squared ends of said block, grinding the top surface of said block to produce a plurality of longitudinal grooves and ridges of varying heights, removing the ridges of varying heights from said top surface thereby producing a surface having ridges of uniform height and grooves of uniform depth, rotating said block 180 degrees to an upside down position, grinding said bottom surface to produce a plurality of longitudinal grooves and ridges of varying heights, removing said ridges of varying heights from said bottom surface thereby producing a surface having ridges of uniform height and grooves of uniform depth and further including the step of sawing the block into two equal halves.

In yet another of its aspects, the invention provides a process for the manufacture of pavers, steps and coping stones for use as building or landscape stones comprising quarrying natural stone from a quarry, splitting the quarried stone into rectangular blocks having a natural top surface and a natural uneven bottom surface and two end faces, sawing each end face of said block to produce squared ends of said block, rotating said block 180 degrees to an upside down position, grinding said bottom surface to produce a plurality of longitudinal grooves and ridges of varying heights and removing the ridges of varying heights from the bottom surface thereby producing a surface having ridges of uniform height and grooves of uniform depth.

DETAILED DESCRIPTION OF THE DRAWINGS

The invention provides a process for producing dimensionally split-face landscape and building stone blocks by means of an automated process.

Natural stone is quarried from an appropriate source. The natural stone may be limestone, sandstone, metamorphic stone and granite or any suitable stone. It is generally mined in a quarry which produces natural slabs of stone. The slabs are put through a conventional mechanical hydraulic stone splitter which produces rectangular blocks of stone 2 with end faces 8 (only one end face is shown as the opposite end face not shown is identical to the end face shown).

Any conventional mechanical stone splitter may be used. One such example is available from Park Industries, Inc. of St. Cloud, Minn., U.S.A. and sold under the trade mark HYDRASPLIT. This is an example of a conventional stone splitter which makes high quality splits on a variety of stones. A second model is available from Park Industries, Inc. under product code number 60-26-300 UH and sold in association with the trade mark HYDRASPLIT.

A typical and conventional stone splitter uses up to 300 tons of pressure which is exerted on the stone layer to cut it by splitting it into uniform stone blocks. The machine's cutting edge consists of multiple chisels that adjust individually to the natural contours of the stone layers. The individual chisels provide for equalised pressure which allows for the stone to be cut or split in straight lines.

Figure 1:
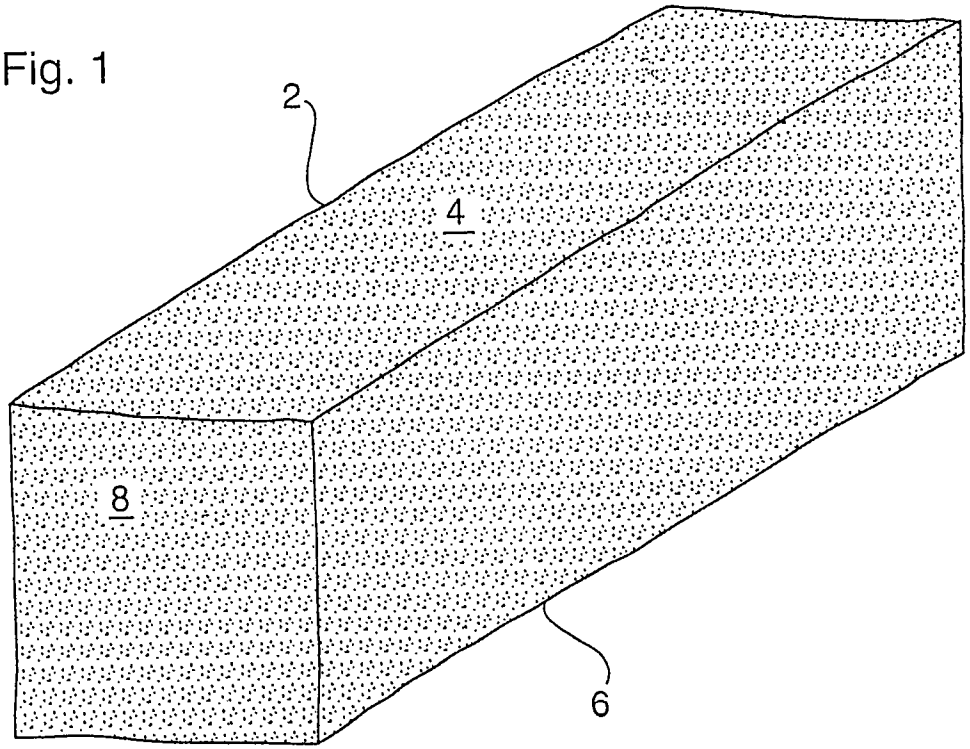
FIG. 1 shows a rectangular block of stone produced from natural stone layers by a conventional mechanical stone splitter.
Figure 2:
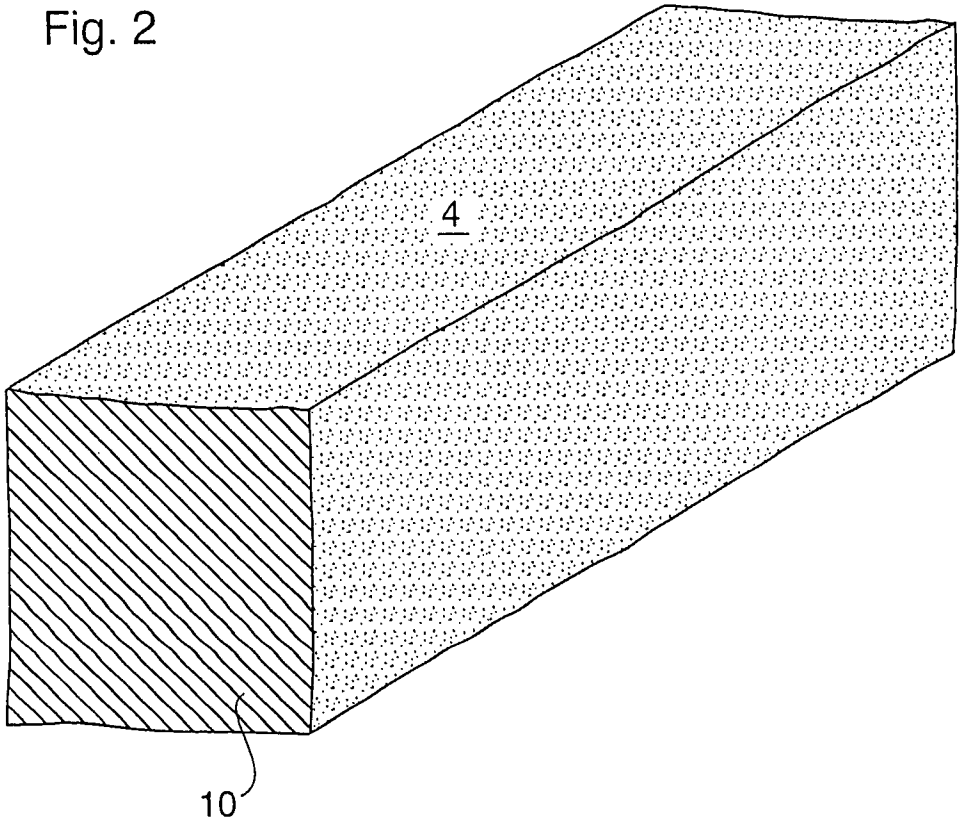
FIG. 2 shows the block of FIG. 1 wherein both rough ends of the block are sawn perpendicular to produce squared ends.
Figure 3:
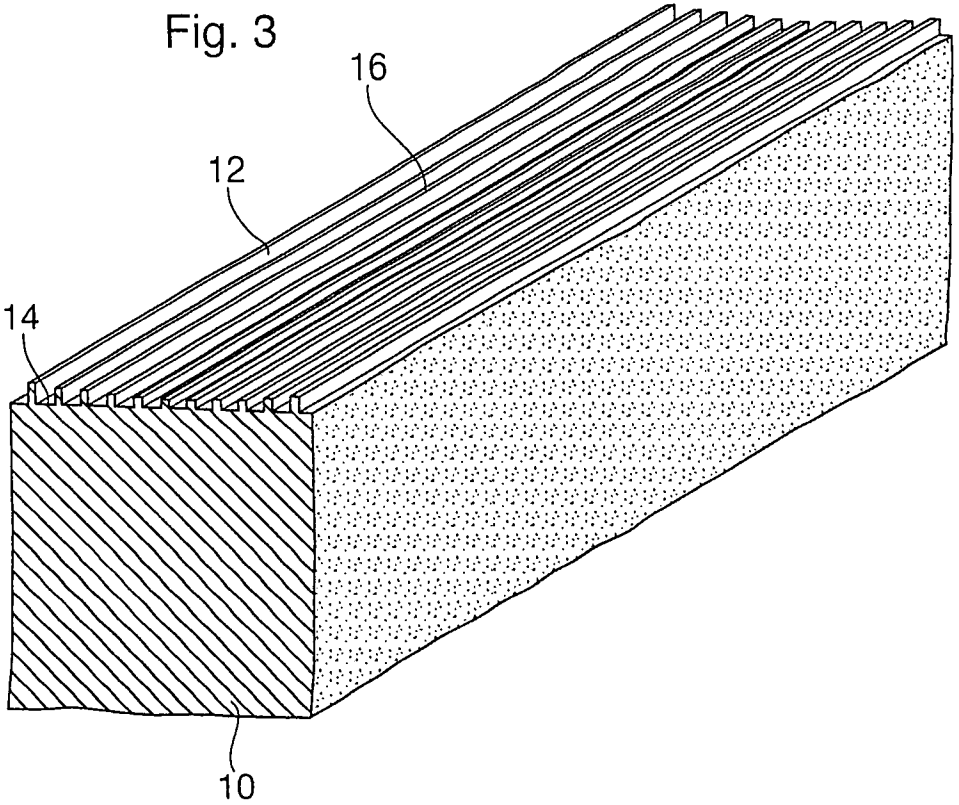
FIG. 3 shows the first stage of the process wherein a first surface is ground to produce grooves.
Figure 4:
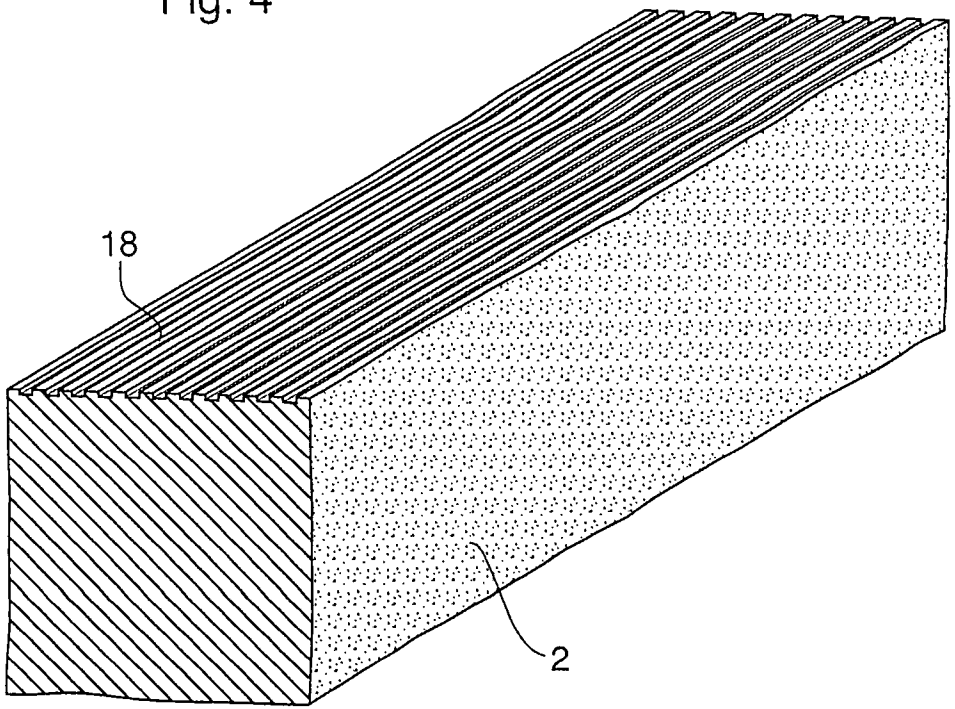
FIG. 4 shows the second stage of the process wherein the remaining ridges are removed.
Figure 5:
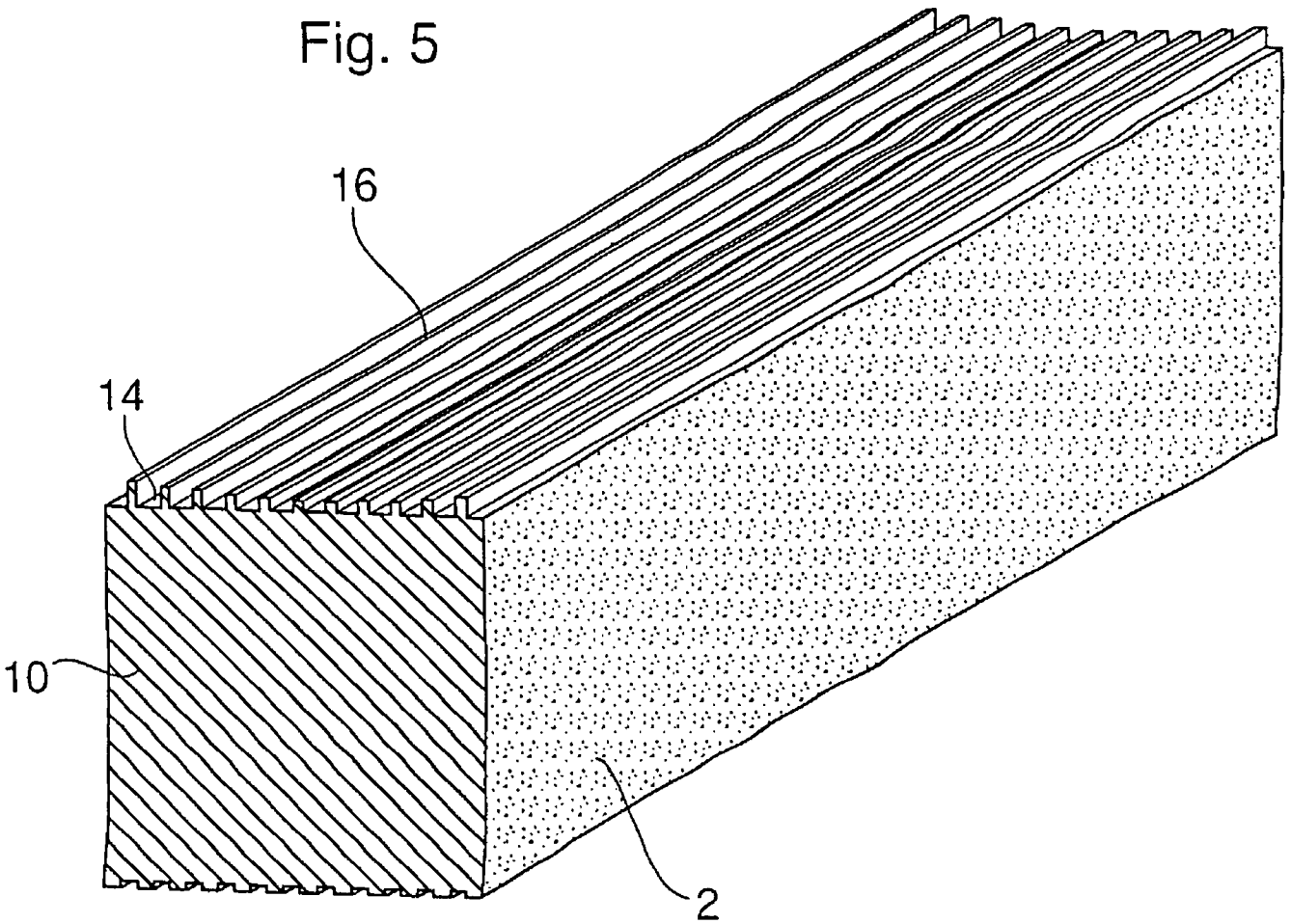
FIG. 5 shows the block rotated 180 degrees into an upside down position and the first stage of the process on the inverted block.

The typical block width is approximately 8 inches and the lengths may vary from about 12 inches to about 36 inches. The height of the block is generally dependent on the thickness of the naturally occurring layers of stone chosen. The layers generally vary from about 2 inches to about 15 inches. As shown in FIG. 1, both the top surface 4 and the bottom surface 6 of the block 2 are rough and uneven and are natural cleft stone surfaces.

Figure 6:
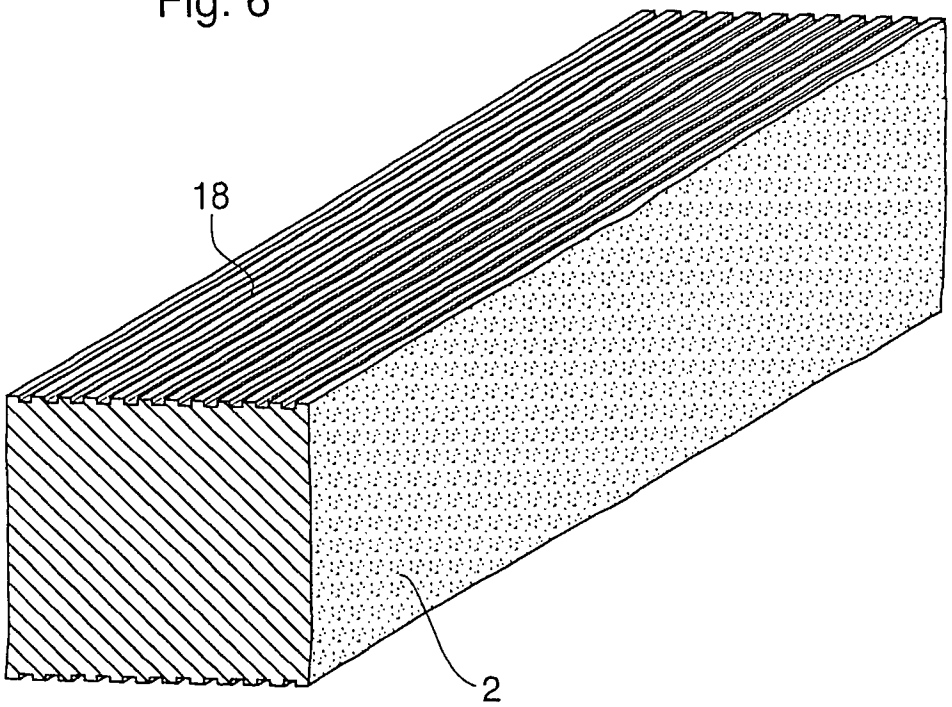
FIG. 6 shows the second stage of the process on the inverted block.

The next step in the process is to saw each end face 8 which produces a block 2 having squared ends 10 as shown in FIG. 6.

The block 2 is then moved through a grinder (not shown) which grinds the natural cleft rough top surface 4 resulting in a surface 12 which carries consistent grooves 14 with ridges 16 of varying heights.

The grinder is a conventional grinder and uses a plurality of matching diamond blades mounted on the same shaft.

The block 2 is now processed through the second stage wherein the ridges 16 remaining from the previous step are removed by grinding the ridges with multiple matching blades. The blades preferably penetrate about one-eighth inch deeper than in the previous step thereby producing a consistently finished grooved surface 18 on the top of the block 2.

The block 2 is now rotated 180 degrees to an upside down position and the process is repeated on the bottom surface. The desired height of the grooves is calculated and the grooves are formed of the desired height.

As illustrated in FIG. 6, the top and bottom surfaces of the block now a have finished groove surface of the desired height. The block may now be used as a finished landscape stone block.

If the block is to be used as a building block, then the block is sawn by a single diamond blade longitudinally into two equal halves thereby reducing the 8-inch wide block into two 4 inch wide stone blocks useful for the building stone industry. These blocks now have a sawn backside and a split front face and are complete for sale and use.

Pavers, steps and coping stones may also be produced by the process. Pavers are used to create patios, walkways and driveways. Steps are used in pedestrian areas where there is a change in elevation between patios, walkways, driveways or building entrances. Copings are used to manufacture an architectural partition with a height and length usually greater than the thickness. They are used to divide or enclose an area or to support another structure. Copings may be placed on the top of a wall to serve as a cover for the wall. The pavers, steps and coping stones have a smooth natural top surface and grooves on the bottom surface only. Pavers, steps and coping stones may be produced from granite, sandstone, limestone or metamorphic stone. These various stones are usually 8 to 24 inches wide and the grooves set on the bottom of each stone interacts with the stone immediately below it to ensure proper construction.

Although the disclosure describes and illustrates a preferred embodiment of the invention, it is to be understood that the invention is not limited to this particular embodiment. Many variations and modifications will now occur to those skilled in the art. For a definition of the invention, reference is now made to the appended claims.

I claim:

1. A process for the manufacture of stone blocks for use as finished landscape stone blocks from quarry stone, comprising:

a. quarrying natural stone from a quarry;

b. splitting the quarried stone into rectangular blocks having a top surface, a bottom surface and two end faces;

c. sawing each end face of said block to produce squared ends of said block;

d. grinding the top surface of said block to produce a plurality of longitudinal grooves and ridges of varying heights;

e. removing the ridges of varying heights from said top surface thereby producing said top surface having ridges of uniform height and grooves of uniform depth;

f. rotating said block 180 degrees to an upside down position;

g. grinding said bottom surface to produce a plurality of longitudinal grooves and ridges of varying heights;

h. removing said ridges of varying heights from said bottom surface thereby producing said bottom surface having ridges of uniform height and grooves of uniform dept.

2. A process for the manufacture of stone blocks for use as building stone blocks from quarry stone, comprising the process of claim 1 further including the step of sawing the block into two equal halves.

3. A process as claimed in claim 1 wherein said quarry stone is selected from limestone, sandstone, metamorphic stone and granite.

4. A process as claimed in claim 1 wherein said split rectangular block is about eight inches wide, twelve to thirty-six inches long.

5. A process as claimed in claim 4 wherein said block is from about two to about fifteen inches high.

6. A process as claimed in claim 1 wherein said quarried natural stone is split using a mechanical hydraulic stone splitter.

7. A process as claimed in claim 1 wherein said ridges are removed using a grinder.

8. A process as claimed in claim 2 wherein said quarry stone is selected from limestone, sandstone, metamorphic stone and granite.

9. A process as claimed in claim 2 wherein said split rectangular block is about eight inches wide, twelve to thirty-six inches long.

10. A process as claimed in claim 9 wherein said block is from about two to about fifteen inches high.

11. A process as claimed in claim 2 wherein said quarried natural stone is split using a mechanical hydraulic stone splitter.

12. A process as claimed in claim 2 wherein said ridges are removed using a grinder.

13. A process for the manufacture of pavers, steps and coping stones for use as a finished landscape stone block from quarry stone, comprising:

a. quarrying natural stone from a quarry;

b. splitting the quarried stone into rectangular blocks having a smooth natural top surface an uneven bottom surface and two end faces;

c. sawing each end face of said block to produce squared ends of said block;

d. grinding the uneven bottom surface of said block to produce a plurality of longitudinal grooves and ridges of varying heights; and e. removing the ridges of varying heights from said bottom surface thereby producing said bottom surface having ridges of uniform height and grooves of uniform depth.

* * * * *